US005765445A

United States Patent [19]

Miyata

[11] Patent Number: 5,765,445

[45] Date of Patent: Jun. 16, 1998

[54] HAND LEVER DEVICE

[75] Inventor: Hiromasa Miyata, Tokyo, Japan

[73] Assignee: Kioritz Corporation, Tokyo, Japan

[21] Appl. No.: 688,798

[22] Filed: Jul. 31, 1996

[30] Foreign Application Priority Data

Aug. 4, 1995 [JP] Japan ..... 7-199583

[51] Int. Cl.[6] ..... G05G 1/04; G05G 5/04

[52] U.S. Cl. ..... 74/501.6; 74/526; 74/502.2; 56/DIG. 18

[58] Field of Search ..... 74/501.6, 502.2, 74/526, 523, 108; 56/DIG. 18, 10.8; 30/276, 382

[56] References Cited

U.S. PATENT DOCUMENTS

| | | | |
|---|---|---|---|
| 2,520,209 | 8/1950 | Hill | 74/526 X |
| 3,211,933 | 10/1965 | Kohlhagen | 74/526 X |
| 3,486,397 | 12/1969 | Roock et al. | 74/501.6 |
| 4,798,185 | 1/1989 | Driggers | 74/502.2 X |
| 5,212,886 | 5/1993 | Tasaki . | |
| 5,398,567 | 3/1995 | Specht | 74/523 |
| 5,544,544 | 8/1996 | Hoppner et al. | 74/526 |

FOREIGN PATENT DOCUMENTS

| | | | |
|---|---|---|---|
| 182048 | 10/1954 | Germany | 74/502.2 |

*Primary Examiner*—Charles A. Marmor
*Assistant Examiner*—Mary Ann Battista
*Attorney, Agent, or Firm*—Cushman Darby Cushman Intellectual Property Group of Pillsbury Madison & Sutro LLP

[57] ABSTRACT

A hand lever device which is capable of combining high safety with excellent operability. The hand lever device includes a housing and a main lever pivotally attached to the housing. A spring member is fixedly mounted on the main lever, and is bendable in the direction along pivotal movement of the main lever. The spring member has a free end formed into a holder holding a terminal piece of a cable connected to a driven member. A stopper stops the holder of the spring member with cable at a desired drawn position of cable when main lever is pivotally operated to draw cable via spring member.

9 Claims, 5 Drawing Sheets

HAND LEVER DEVICE

BACKGROUND OF THE INVENTION

1. Field of the Invention

The present invention relates to a hand lever device for operating a driven member, such as a throttle valve, of an internal combustion engine via a cable. In particular, the hand lever is preferably mounted on a working machine, such as a hedge trimmer or brush cutter, in the vicinity of a hand grip so that it is easy and convenient to operate a throttle valve or the like via a throttle cable or the like.

2. Description of the Prior Art

For example, in a working machine such as a hedge trimmer and brush cutter, an operative portion including a cutting blade or the like is driven by an internal combustion engine. A hand lever device is provided for controlling the degree of opening of a throttle valve of the internal combustion engine. Such a hand lever is mounted in the vicinity of a grip of a U-shaped handle, a bar handle or the like of the working machine so as to provide manual control of the output force of the internal combustion engine.

The hand lever device is generally provided with a throttle trigger (throttle lever) operated by the operator's fingers with the throttle lever being pivotally operated to thereby control the degree of opening of the throttle valve via a throttle cable. In general, the throttle valve is always biased toward the direction of the minimum valve opening that allows the engine to idle. Accordingly, the throttle valve is normally kept at the idle opening position and, when the throttle cable is drawn, it begins to open from the opening position for idling (slow running) of the engine toward an opening position for operation (higher speed running) of the engine.

Such known hand lever devices for controlling throttle valve settings include an automatic return to an idle setting type and an immobilizable type. In the former type, when such a throttle lever is released from a pivotal operation position, the lever is automatically returned to its original idle position setting, thereby moving the throttle valve to its idle setting. In the latter type, when fingers are released from a throttle lever, the throttle lever is immobilized at a desired pivotal operation position (see, for example, Japanese Examined Utility Model Publication No. 19944/1982).

In the auto-return type, when fingers are released from the throttle lever, the engine is automatically returned to idling condition. Consequently, when the auto-return type is used in a working machine, where the output force of the engine is transmitted to an operative portion including a cutting blade via a centrifugal clutch, the centrifugal clutch is disconnected to cut off the transmission of the driving force to the operative portion. Accordingly, the operation of the machinery can immediately be stopped by returning the throttle valve to the opening degree for idle running if an accident occurs, thereby advantageously attaining improved safety. On the other hand, the throttle valve must be held continuously by fingers at a desired pivotal operation position to achieve the desired operation of the machinery. This causes problems in that this type is awkward with respect to intermediate opening degrees, the fingers are susceptible to fatigue, and the speed of the engine is likely to be unstable.

In general, it is desired for operational convenience that a lever which is pivotally operated, for example, a throttle lever be alternatively shifted between two positions, such as a released position and a set position (gripped position) without being suspended at any intermediate position.

Accordingly, it is preferred in terms of operability that the lever be set in the same pivotal operation position (set position) regardless of whether an intermediately open condition (partially open condition) or the fully open condition (W.O.T.) of a throttle valve is intended.

On the other hand, the immobilizable type is capable of solving the above problems associated with the auto-return type. The immobilizable type advantageously holds the throttle lever at a desired pivotal operation position without the throttle lever being held by the operator's fingers. This enables an easy cutting operation because fingers are liberated from holding it. However, since additional operation is required to release the throttle lever from the immobilized position, it is impossible to immediately stop the machinery even if an accident occurs. Accordingly, there is a problem that, in terms of safety, the immobilizable type is inferior to the auto-return type.

SUMMARY OF THE INVENTION

The present invention has been made in view of these problems. It is, therefore, an object of the present invention to provide a hand lever device which is free of the above-mentioned drawbacks inherent in the auto-return type and the immobilizable type and which combines the advantages of these types. For example, the hand lever device permits a throttle valve to be appropriately adjusted via a cable to its degree of opening and kept at a desired opening degree, and yet, immediately returned to the opening degree associated with an idle condition. This ensures high safety and diminishes fatigue of fingers and provides preferred operability.

To attain the above-mentioned objective, the hand lever device according to the present invention, as a basic embodiment, comprises:

a housing, a main lever pivotally attached to the housing, a spring member fixedly mounted on the main lever, the spring member being bendable in the direction along pivotal movement of the main lever, the spring member having its free end formed into a holder holding a terminal piece of a cable connected to a driven member, and a stopper for stopping the connection (holder) of the spring member with the cable at a desired drawn position of the cable when the main lever is pivotally operated to draw the cable via the spring member.

The preferred embodiments of the present invention includes one wherein the stopper includes a cam member with an eccentric cam portion, one wherein the spring member is made of a leaf spring, and one wherein the driven member is a throttle valve of an internal combustion engine.

Where the driven member is a throttle valve of an internal combustion engine, a working machine comprises an operative portion including a cutting blade driven by the internal combustion engine whose throttle valve is biased in the direction of a degree of opening that allow the engine to idle. When a throttle cable connected thereto is drawn from a non-operating position, the throttle valve begins to open from the opening position for the idle condition. One form of the hand lever device which is preferably disposed in the vicinity of a hand grip of such a working machine comprises:

a housing, a main lever pivotally attached to the housing, a spring member fixedly mounted on the main lever, the spring member being made of a leaf spring bendable in the direction along pivotal movement of the main lever, the spring member having its free end formed into a holder holding a terminal piece of a cable connected to a driven member, and a stopper for stopping the connection (holder) of the spring member with the cable at a desired drawn position of the cable when the main lever is pivotally operated to draw the cable via the spring member, the stopper including a cam member with an eccentric cam portion.

In the preferred form of the hand lever device according to the present invention, which is constructed as described above, when the main lever is in the released position, the throttle valve is in the minimum opening position that allows the engine to idle. When the main lever is pivotally operated from this position, the throttle cable is drawn via the spring member made of a leaf spring to rotate the throttle valve from the minimum opening position toward an opening position for running of the engine at a higher speed. In the course of the movement of the main lever, the spring member abuts on the stopper. Thus, the connection in the spring member with the throttle cable is consequently interrupted in its movement and kept at a desired drawn position of the throttle cable. On the other hand, the further pivotal movement of the main lever is uninterruptedly continued to the set position, where the outer surface of the main lever is substantially flush with the grip, because of the bending action of the spring member. The bending action of the spring member absorbs the further pivotal movement of the main lever.

Therefore, by preliminarily adjusting the position of the stopper, the drawn position of the throttle cable is determined with respect to the connection in the spring member with the throttle cable. The drawn amount of the throttle cable is thereby controlled. In other words, the degree of opening of the throttle valve is controlled. Further, in the event that it is necessary to immediately lower the speed of the engine due to the occurrence of an accident or the like, the main lever can be completely released. The main lever, spring member, throttle cable and throttle valve are automatically returned to the respective original positions which allow the engine to idle. Consequently, the engine is brought into its idle condition. If the working machine is adapted so that rotational driving force of the engine is transmitted to the operative portion including the cutting blade and the like via a centrifugal clutch, the centrifugal clutch is disconnected to cut off the transmission of the driving force to the operative portion. Thus, the operation of the operative portion including the cutting blade and the like is immediately stopped.

DESCRIPTION OF THE PREFERRED EMBODIMENTS

The present invention will be described in more detail with reference to the accompanying drawings.

Figure 1:
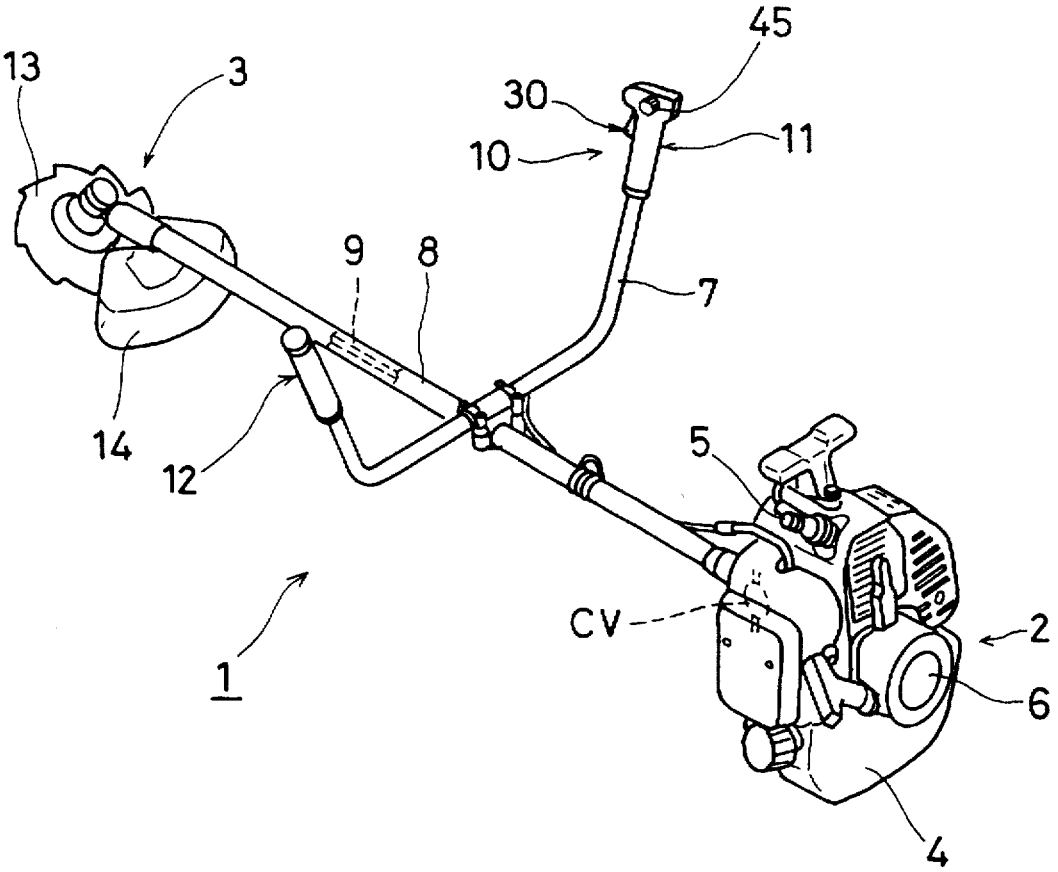
FIG. 1 is a perspective view showing an example of a brush cutter adopting one embodiment of the hand lever device according to the present invention.

FIG. 1 shows an example of a brush cutter employing one embodiment of the hand lever device according to the present invention. The illustrated brush cutter 1 comprises a U-shaped handle 7 provided with right and left grips 11, 12 spaced a predetermined distance apart. An operating rod 8 supports the U-shaped handle 7, and an operative portion 3 is provided on the distal end of the operating rod 8. The operative portion 3 includes a cutting blade 13, a safety cover 14 and so forth. The brush cutter 1 further comprises an internal combustion engine 2, for example, a small air-cooled two-cycle gasoline engine, which is disposed on the proximal end of the operating rod 8. The engine 2 provides driving power for driving the cutting blade 13 via a drive shaft 9 extending through and within the operating rod 8. The internal combustion engine 2 is provided with a carburetor (not shown) having a throttle valve CV and a spark plug 5. The combustion engine is also provided with a fuel tank 4 and a recoil starter 6.

In this example, the throttle valve CV is always biased in the direction of a minimum degree of opening (for an idle condition). When a throttle cable 22 connected thereto (as shown in FIG. 2 and described below), is drawn from the non-operating position, the throttle valve CV begins to open from the minimum idle opening position.

One embodiment of the hand lever device 10, according to the present invention, is provided in the vicinity of the grip 11. Grip 11 is the one of the grips 11 and 12 that is gripped generally by an operator's right hand. The hand lever device 10 is used to adjust the degree of opening of the throttle valve CV.

Figure 2:
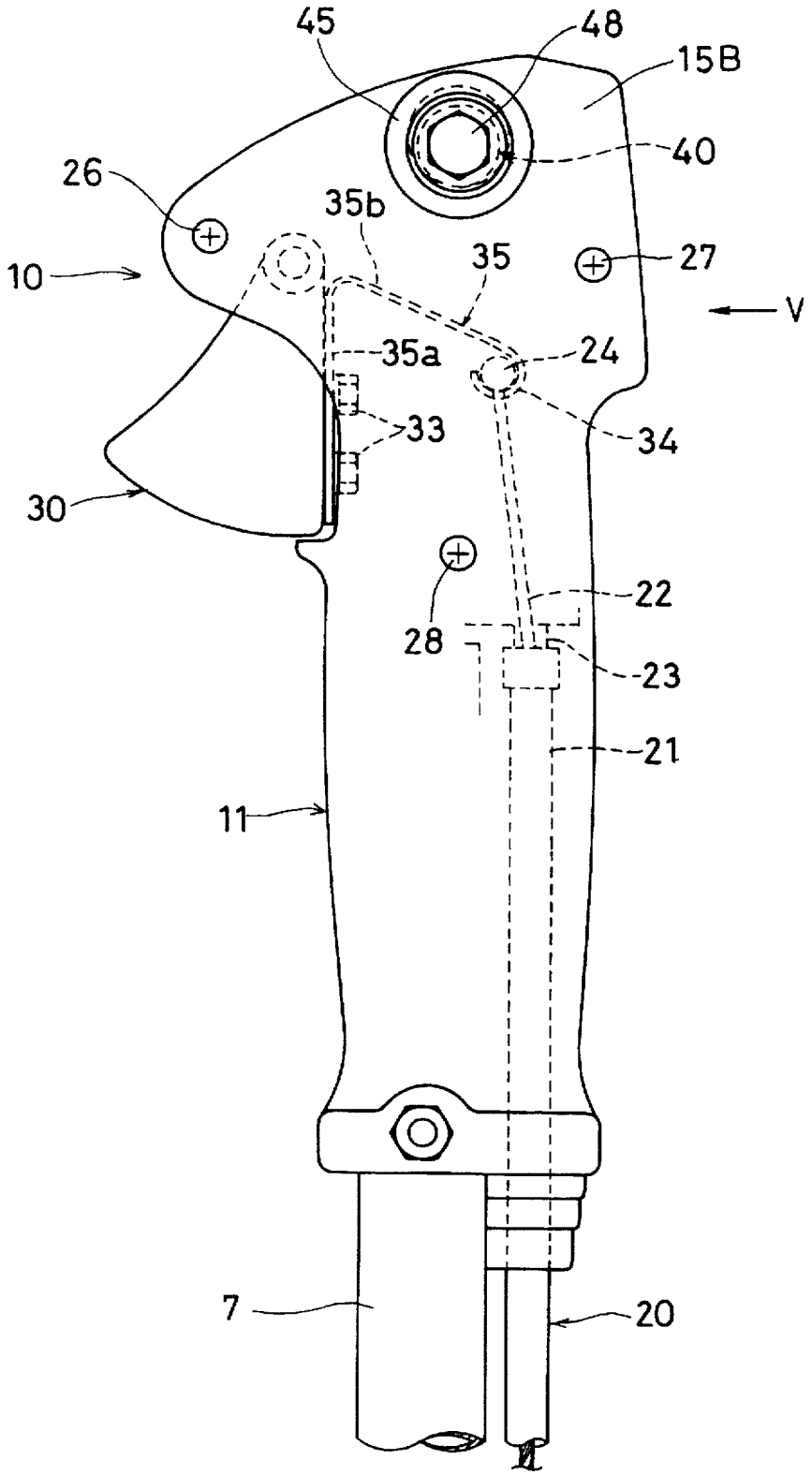
FIG. 2 is a left side view showing the one embodiment of the hand lever device according to the present invention.
Figure 3:
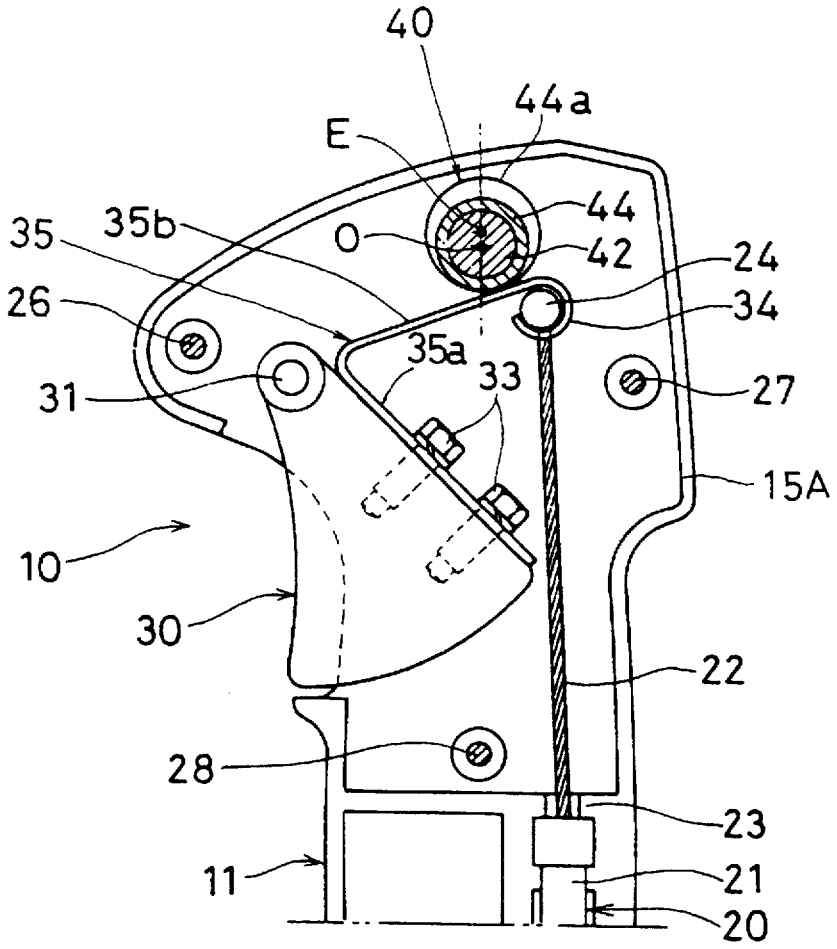
FIG. 3 is a sectional left side view of the embodiment shown in FIG. 2 where a throttle valve is in its full open condition.
Figure 4:
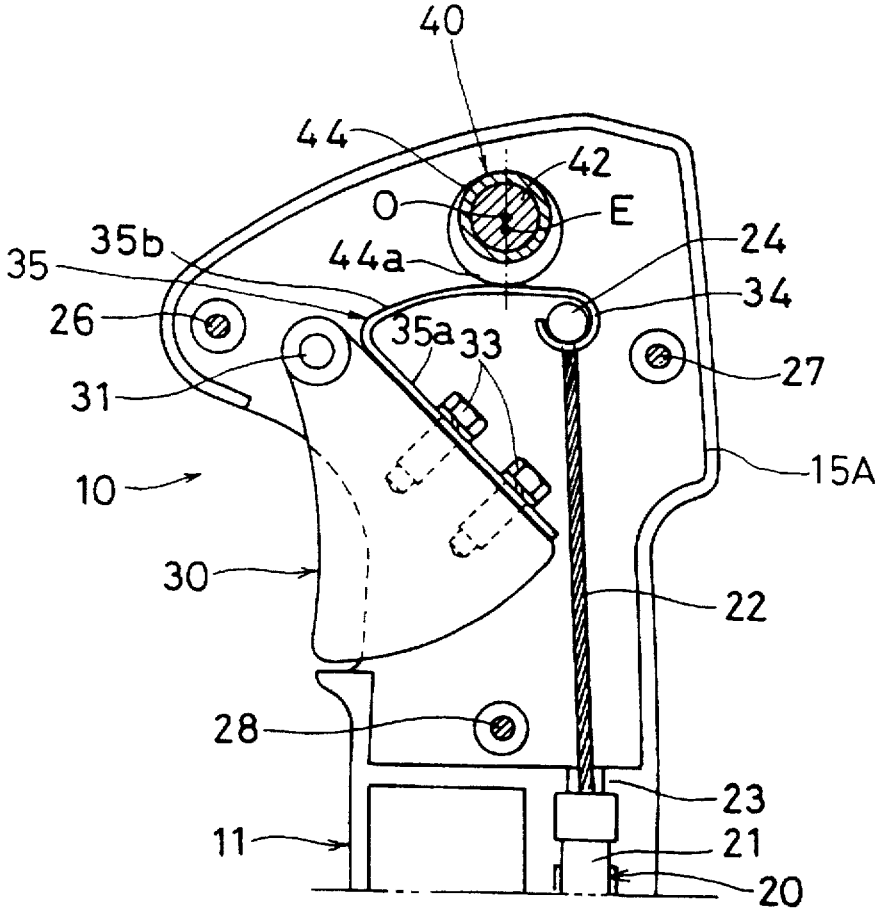
FIG. 4 is a sectional left side view of the embodiment shown in FIG. 2 where the throttle valve is in its partial open condition.

As shown in FIGS. 2 to 4, the hand lever device 10 is located at the head portion of the grip 11 composed of cover members 15A and 15B (hereinafter often referred to simply as cover 15A, 15B). Cover 15A, 15B is clamped together by means of clamping members 26, 27 and 28 such as screws. The hand lever device 10 comprises a substantially fan-shaped main lever 30 pivotally supported at its base end by a pin 31, a spring member 35 made of a leaf spring and having a substantially "dog-legged" shape when viewed sideways, and a stopper 40 in the form of an eccentric cam shaft.

The spring member 35 includes a mounting portion **35*a* fixedly mounted on the inner side of the main lever 30 by screws 33 and a bendable portion 35*b* having its free end formed into a tubular holder 34. The holder 34 holds therein a terminal metal piece 24 of a throttle cable (inner cable) 22 extending through and within an outer tube 21 of a Bowden cable 20. The bendable portion 35*b* has an appropriate spring constant which is selected to overcome the biasing force on the throttle valve CV and to minimize load on the operator's finger while drawing the main lever 30**.

Figure 5:
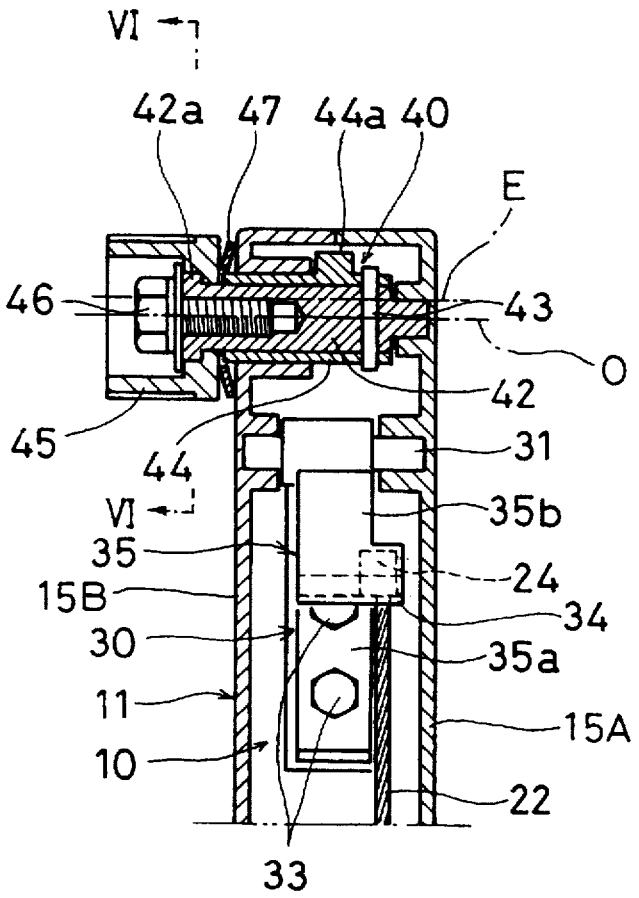
FIG. 5 is a vertical sectional view of the embodiment in FIG. 2 viewed in the direction of arrow V.
Figure 6:
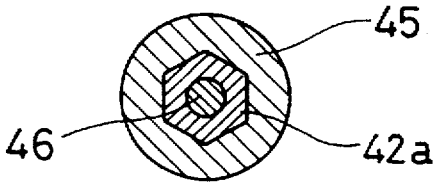
FIG. 6 is a sectional view taken along the line VI—VI and viewed in the direction of the arrows in FIG. 5.

As shown in FIG. 5 in addition to FIGS. 2 to 4, the stopper 40 comprises a supporting shaft 42, a cam member 44 with an eccentric circular cam portion **44*a*, and an adjusting dial 45. The supporting shaft 42 is rotatably supported in the upper end portion of the cover 15A, 15B in parallel with the main lever 30 and has an axis of rotation 0. The cam member 44 with an eccentric circular cam portion 44*a* is externally fitted on the supporting shaft 42 and fixed thereto by a pin 43. The adjusting dial 45 is fitted on a hexagonal portion 42*a* provided at one end of the supporting shaft 42 which outwardly protrudes from the cover member 15B and fixed thereto by a screw 46. The adjusting dial 45 has a knurled peripheral surface. The eccentric circular cam portion 44***a* of the cam member 44 has its center E eccentrically located at a predetermined distance apart from the axis of rotation 0.

Between the adjusting dial 45 and the cover member 15B, a belleville spring 47 is interposed. By adjusting the screw-in amount of the screw 46 under the elastic action of the belleville spring 47, frictional force between the adjusting dial 45 and the cover member 15B is controlled. The adjusting dial 45 is thereby held immobilized at a desired pivotal operation position.

In the hand lever device 10 of this embodiment which is constructed as described above, when the main lever 30 is in the released condition as shown in FIG. 2, the throttle valve CV is in the minimum opening condition that allows the engine to idle. When the main lever 30 is moved from this condition, the main lever 30 is pivotally operated as shown in FIG. 3 or 4. Consequently, the throttle cable 22 is drawn from the outer tube 21 of the Bowden cable 20 via the spring member 35 made of a leaf spring. The throttle valve CV is thereby moved from the opening condition for idling (slow running) of the engine toward an opening condition for operation (higher speed running) of the engine. In the course of the movement of the main lever 30, the spring member 35 abuts on the cam portion 44*a* of the stopper 40. The tubular holder 34 of the spring member 35, i.e., the connection with the throttle cable 22, is consequently interrupted in its movement and kept at a desired drawn position of the throttle cable. On the other hand, the main lever 30 is further uninterruptedly moved in the pivotal direction to the set position (as shown in FIGS. 3 and 4), where the outer surface of the main lever 30 is substantially flush with the grip 11, because of the bending action of the spring member 35. The bending action of the spring member 35 absorbs the further pivotal movement of the main lever 30 to prevent the throttle cable 22 from being drawn in excess of the desired amount.

Therefore, by preliminarily turning the adjusting dial 45 to adjust the cam portion 44*a* of the stopper 40 to an appropriate position, the drawn position of the throttle cable 22 is determined with respect to the connection with the throttle cable 22, i.e., the holder 34 of the spring member 35. The drawn amount of the throttle cable 22 is thereby controlled. In other words, the degree of opening of the throttle valve CV is controlled.

For example, in the case where the cam portion 44*a* of the stopper 40 is set with its eccentric portion positioned up as shown in FIG. 3, when the main lever 30 is fully gripped to move to the set position, the spring member 35 is just brought into contact with the cam portion 44*a* but not bent. Consequently, as intended, the drawn amount of the throttle cable 22 is maximized and the throttle valve CV is brought into the fully open condition (W.O.T.). On the other hand, in the case where the cam portion 44*a* of the stopper 40 is set with its eccentric portion positioned down as shown in FIG. 4, when the main lever 30 is fully gripped to the set position, the spring member 35 is pressed against the cam portion 44*a* and bent downwardly. Consequently, the drawn amount of the throttle cable 22 is smaller than the maximum amount shown in the former case. Thus, the throttle valve CV is brought into an intermediately open condition (partially open condition) of, for example, 50% of the fully open condition. The cam portion 44*a* may appropriately be modified, for example, in its size or shape, to change the lower limit of the intermediately open condition of the throttle valve CV relative to the fully open condition.

As described above, according to this embodiment, the main lever 30 is alternatively shifted between the two positions, i.e., the released position and the set position (pressed position). Accordingly, the main lever may be set in the same pivotal operation position (set position) regardless of whether an intermediately open condition (partially open condition) or the fully open condition (W.O.T.) of the throttle valve CV is intended. This provides markedly enhanced operability.

Further, in the event that it is necessary to immediately lower the speed of the engine 2 due to the occurrence of an accident or the like, the main lever 30 can be completely released. The main lever 30, the spring member 35, the throttle cable 22 and the throttle valve CV are automatically returned to the respective original positions which allow the engine to idle. In consequence, the engine 2 is brought into its idle condition. If the working machine is adapted so that rotational driving force of the engine is transmitted to the operative portion 3 including the cutting blade 13 and the like via a centrifugal clutch, the centrifugal clutch is disconnected to cut off the transmission of the driving force to the operative portion 3. Thus, the operation of the operative portion 3 including the cutting blade 13 and the like is immediately stopped.

The present invention has been described in detail with reference to the one embodiment. It is, however, to be understood that the present invention is by no means restricted to the illustrated embodiment and that various modifications may be made within the scope which does not depart from the spirit of the present invention as defined in the claims.

For example, in the above example, the hand lever device 10 according to the present invention is used to control the degree of opening of the throttle valve CV of the internal combustion engine 2. The hand lever device of the present invention may, of course, be used in other applications than adjustment of the degree of opening of the throttle valve CV.

Further, the main lever may be a long lever which is held by fingers, instead of the trigger-like lever as illustrated.

Moreover, the hand lever device 10 as such may be used by mounting it on a bar handle and the like beside the U-shaped handle 7.

As understood from the above description, according to the hand lever device of the present invention, the hand lever device permits a throttle valve to be appropriately adjusted via a cable to its degree of opening. The throttle valve can be kept at a desired opening degree, and yet, immediately returned to the opening degree associated with an idle condition. This ensures high safety and diminishes fatigue of fingers and provides preferred operability.

What is claimed is:

1. A hand lever device comprising:

a housing, a main lever pivotally attached to said housing, a spring member fixedly mounted on said main lever, said spring member being bendable in the direction along pivotal movement of said main lever, said spring member having a free end formed into a holder holding a terminal piece of a cable connected to a driven member, and a stopper for stopping said holder of said spring member with said cable at a desired drawn position of said cable when said main lever is pivotally operated to draw said cable via said spring member;

wherein said stopper includes a cam member with an eccentric cam portion.

2. The hand lever device according to claim 1, wherein said spring member is made of a leaf spring.

3. The hand lever device according to claim 1 or 2, wherein said driven member is a throttle valve of an internal combustion engine.

4. The hand lever device according to claim 1, wherein said eccentric cam portion is arranged substantially within said housing.

5. The hand lever device according to claim 4, wherein the positioning of said cam member is adjustable with respect to the housing.

6. The hand lever device according to claim 1, wherein said eccentric cam portion stops said holder of said spring member at said desired drawn position by abutting against the spring member.

7. The hand lever device according to claims 1, 4, 5, or 6, wherein a belleville spring is interposed between said housing and said stopper.

8. The hand lever device according to claim 7, wherein said spring member is made of a leaf spring.

9. The hand lever device according to claim 7, wherein said driven member is a throttle valve of an internal combustion engine.

* * * * *